US009249660B2

(12) United States Patent
Habib et al.

(10) Patent No.: US 9,249,660 B2
(45) Date of Patent: Feb. 2, 2016

(54) FORMATION FLUID SAMPLING

(75) Inventors: Rana Khalid Habib, Shekou (CN); Erik Quam, Sugar Land, TX (US); Sylvain Bedouet, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 44 days.

(21) Appl. No.: 13/305,400

(22) Filed: Nov. 28, 2011

(65) Prior Publication Data

US 2013/0133885 A1 May 30, 2013

(51) Int. Cl.
*E21B 49/08* (2006.01)

(52) U.S. Cl.
CPC ..... *E21B 49/084* (2013.01)

(58) Field of Classification Search
USPC ..... 166/264; 175/59; 73/152.23, 152.28, 73/152.24–152.27
See application file for complete search history.

(56) References Cited

U.S. PATENT DOCUMENTS

| | | | |
|---|---|---|---|
| 4,547,691 | A | 10/1985 | Valdois et al. |
| 5,394,345 | A | 2/1995 | Berard et al. |
| 6,092,416 | A | 7/2000 | Halford et al. |
| 7,379,180 | B2 | 5/2008 | Vannuffelen et al. |
| 2008/0066535 | A1 | 3/2008 | Vasques et al. |
| 2008/0066536 | A1 | 3/2008 | Goodwin et al. |
| 2008/0115934 | A1 * | 5/2008 | Pettinato et al. ..... 166/254.1 |
| 2008/0257036 | A1 | 10/2008 | Chaudoreille et al. |
| 2008/0302529 | A1 * | 12/2008 | Fowler et al. ..... 166/250.01 |
| 2009/0078036 | A1 | 3/2009 | Terabayashi et al. |
| 2009/0260798 | A1 | 10/2009 | Brennan, III et al. |
| 2011/0083842 | A1 | 4/2011 | Indo et al. |

FOREIGN PATENT DOCUMENTS

| | | | |
|---|---|---|---|
| WO | WO 2008100156 | A1 * | 8/2008 |
| WO | 2011043890 | A2 | 4/2011 |
| WO | 2011139570 | A2 | 11/2011 |

OTHER PUBLICATIONS

Fossa, Arild, "Emission-Free Sampling and Well Testing System", AADE 2001 National Drilling Conference, Houston Texas, Mar. 27-29, 2011, 10 pages.

* cited by examiner

*Primary Examiner* — Taras P Bemko
(74) *Attorney, Agent, or Firm* — Kenneth L. Kincaid; Cathy Hewitt

(57) ABSTRACT

An apparatus disclosed herein includes a downhole tool having a body defining an interior bore and an exterior surface. The example apparatus also includes first and second fluid ports to provide respective fluid paths between the exterior surface and the interior bore. The first fluid port is to receive wellbore fluid from an annulus of a wellbore in which the downhole tool is to be disposed and the second fluid port is to receive formation fluid extracted from a subterranean formation. The formation fluid is to mix with the wellbore fluid to form an output mixture in the interior bore. The example apparatus also includes a controller to control a concentration of the formation fluid in the output mixture.

14 Claims, 4 Drawing Sheets

FORMATION FLUID SAMPLING

BACKGROUND OF THE DISCLOSURE

Formation fluid is often extracted from a subterranean formation to test and/or analyze characteristics of the formation fluid. A drill string including a downhole tool or a formation sampling tool may be disposed in a borehole. During a sampling operation, the formation fluid extracted from the subterranean formation enters the formation sampling tool. After the formation fluid is tested and/or analyzed, the formation fluid may be stored in the tool and/or discarded into an annulus region between the outside of the drill string and the wall of the borehole. Also, during the sampling operation, wellbore fluid may be pumped into an interior of the drill string. The wellbore fluid may flow downwardly through the drill string and may exit the drill string via ports in a drill bit. The wellbore fluid may then circulate upwardly through the annulus region.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
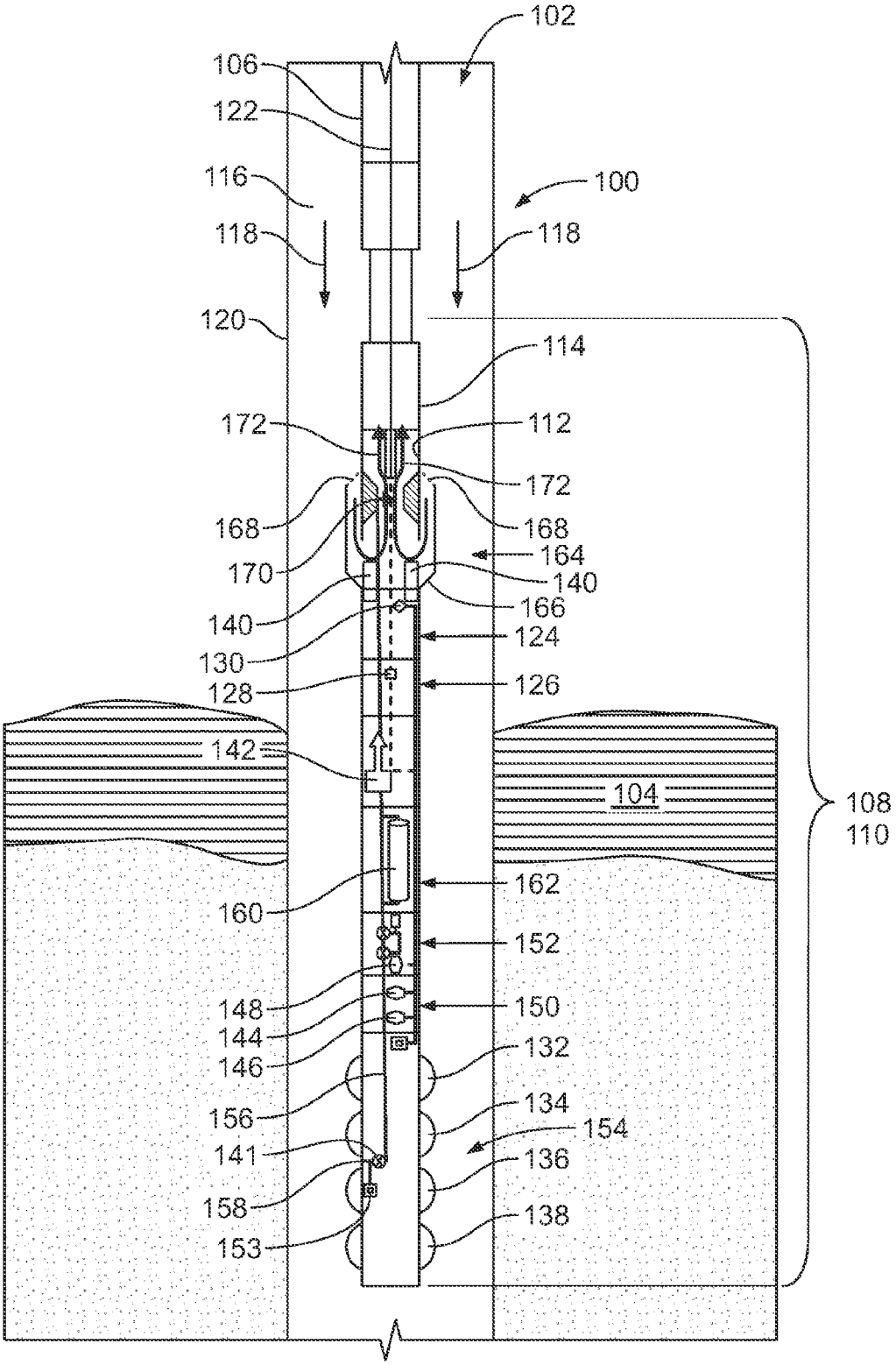
FIG. 1 is a sectional view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features such that the first and second features may not be in direct contact.

One or more aspects of the present disclosure relate to methods and apparatus to test and/or sample formation fluid. The examples disclosed herein may include a downhole tool having a body defining an interior bore and an exterior surface. First and second fluid ports may provide respective fluid paths between the external surface and the interior bore. The first fluid port may receive wellbore fluid from an annulus of a wellbore in which the downhole tool is disposed, and the second fluid port may receive formation fluid extracted from a subterranean formation. The formation fluid and the wellbore fluid may mix to form an output mixture in the interior bore. A controller may control a concentration of the formation fluid in the output mixture and a differential pressure between the wellbore fluid in the annulus and the output mixture in the interior bore during a formation sampling operation by, for example, controlling a flow of the wellbore fluid through the first fluid port and a flow of the formation fluid through the second fluid port. The output mixture may then flow upwardly to the surface. In operation, a pressure of the wellbore fluid in the annulus may correspond to an overbalance condition in the annulus.

The examples disclosed herein may include disposing a downhole tool in a wellbore adjacent to a subterranean formation. Wellbore fluid may then be flowed from an annulus between the downhole tool and the wellbore to a first fluid port of the downhole tool. Formation fluid may be flowed from the subterranean formation into a second fluid port of the downhole tool. The wellbore fluid and the formation fluid may then be mixed within the downhole tool to form an output mixture, and a concentration of the formation fluid in the output mixture may be controlled to control a differential pressure between the interior bore of the downhole tool and the subterranean formation. The concentration of the formation fluid in the output mixture may be controlled, for example, by controlling a flow rate of the wellbore fluid through the first fluid port and controlling a flow rate of the formation fluid through the second fluid port. A pressure of the wellbore fluid in the annulus may correspond to an overbalance condition in the annulus.

Some examples disclosed herein may include disposing a downhole tool in a wellbore adjacent to a subterranean formation and controlling a flow rate of formation fluid from the subterranean formation into an interior bore of the downhole tool. A flow rate of wellbore fluid from an annulus between the downhole tool and the wellbore into the interior bore of the downhole tool may also be controlled. The wellbore fluid and the formation fluid may then be mixed to form an output mixture and cause a differential pressure between the annulus and the interior bore of the downhole tool. The flow rate of the wellbore fluid may be controlled by controlling a valve and/or a pump. The flow rate of the formation fluid may be controlled by controlling a second pump. A pressure of the wellbore fluid in the annulus may correspond to an overbalance condition in the annulus.

FIG. 1 depicts a wellsite system including a downhole tool 100 that may be operated according to one or more aspects of the present disclosure. The wellsite system of FIG. 1 can be employed onshore and/or offshore. In the example wellsite system of FIG. 1, a wellbore 102 is formed in one or more subterranean formations 104 by rotary and/or directional drilling.

As illustrated in FIG. 1, the downhole tool 100 includes a pipe 106 (e.g., a pipe string, a coiled tubing, a work string, etc.) suspended in the wellbore 102. A surface system includes a platform and derrick assembly (not shown) positioned over the wellbore 102. The pipe 106 is suspended in the wellbore 102 from the derrick assembly. The pipe 106 includes a tool string 108. The downhole tool 100 has an elongated body 110 defining an interior bore 112 and an exterior surface 114. The interior bore 112 of the downhole tool 100 extends from the tool string 108 to the surface system. In the example depicted in FIG. 1, the surface system further includes wellbore fluid such as, for example, drilling fluid, which is commonly referred to in the industry as drilling mud, and which may be stored in a pit or other storage facility (not shown) formed at the well site. A surface pump (not shown) pumps the wellbore fluid into an annulus 116 of the wellbore 102 via a kill line (not shown). The wellbore fluid flows in the direction of arrows 118 and creates a mudcake layer (not shown) on the wall 120 of the wellbore 102. As described in greater detail below, the wellbore fluid enters the downhole tool(s) 100 through a fluid port and mixes with formation fluid to form an output mixture in the interior bore 112 of the downhole tool(s) 100.

A logging unit (not shown) is communicatively coupled to a wireline cable 122. The wireline cable 122 transmits data between the logging unit (not shown) and one or more components of the tool string 108. The wireline cable 122 may also provide electrical power to the components of the tool string 108. In some examples, electrical power is provided to the components of the tool string 108 via a mud driven turbine and/or downhole batteries and accumulators. For example, the wireline cable 122 is electrically coupled to a telemetry cartridge 124 and a power cartridge 126. The power cartridge 126 includes electronics boards 128 to receive electrical power from the wireline cable 122. The telemetry cartridge 124 receives and/or sends data via the wireline cable 122. The telemetry cartridge 124 includes a controller 130, which, for example, controls inflation and/or deflation of packers 132, 134, 136, and 138, opening, closing, and/or throttling of valves 140 and 141, pumping of the surface pump (not shown), and regulation of a flow regulator 142. In some examples, the controller 130 analyzes and/or processes data obtained from sensors 144, 146, and 148 disposed in fluid analyzer modules 150 and 152 and/or gauges 153 and/or stores and/or communicates measured or processed data to the surface for analysis.

The example string or tool 108 may be used to extract and analyze formation fluid samples. A fluid admitting assembly 154 is to selectively seal off or isolate selected portions of the wall 120 of the wellbore 102 to fluidly couple the downhole tool 100 to the adjacent subterranean formation 104 and draw formation fluid samples from the subterranean formation 104. Formation fluid enters a main flow line 156 through an inlet 158. The gauge 153 and/or the sensors 144, 146, and 148 are disposed along the main flow line 156 to analyze the formation fluid. The sensors 144, 146, and 148 are disposed in the fluid analyzer modules 150 and 152. Also, formation fluid flowing through the main flow line 156 may be sent to one or more fluid collecting chambers 160 disposed in a sample chamber module 162, which may receive and retain some or all of the formation fluid for subsequent testing at the surface or a testing facility.

Formation fluid that is not sent to the fluid collection chambers 160 flows toward the surface in the main flow line 156 to the flow regulator 142. The flow regulator 142 is disposed along the main flow line 156 downstream of the fluid analyzer modules 150 and 152 and the sample chamber module 162. The flow regulator 142 measures and controls the rate at which the formation fluid flows through the main flow line 156. In some examples, the flow regulator 142 is a pump such as, for example, a pump as described in U.S. Publication No. 2009/0260798, which is incorporated herein by reference in its entirety. Formation fluid passes through the flow regulator 142 toward a diverter module 164. As discussed in greater detail below, the formation fluid and the wellbore fluid flow into the interior bore 112 of the downhole tool 100 through respective fluid paths to mix within the interior bore 112 of the downhole tool 100.

The diverter module 164 diverts wellbore fluid from the annulus 116 into the interior bore 112 of the downhole tool 112 to mix with the formation fluid extracted from the subterranean formation 104. The diverter module 164 is positioned above or uphole relative to the fluid analyzer modules 150 and 152 and the sample chamber module 162 in the orientation of FIG. 1. The diverter module 164 includes a circumferential protrusion 166 that extends toward the wall 120 of the wellbore 102. The diverter module 164 includes first and second fluid ports 168 and 170 to provide respective fluid paths between the exterior surface 114 and the interior bore 112. The first fluid port 168 extends through an upper surface of the circumferential protrusion 166 in the orientation of FIG. 1 to receive wellbore fluid flowing downwardly in the annulus 116 in the direction of arrows 118. The wellbore fluid flows through the first fluid port 168 and diverts uphole into the interior bore 112 of the downhole tool 100 as shown by arrows 172. Further, in some examples, the diverter module 164 does not include the circumferential protrusion 166, and the first fluid port 168 is disposed, for example, on the side of the diverter module 164.

The second fluid port 170 fluidly communicates with the main flow line 156 to provide a fluid path to receive formation fluid extracted from the subterranean formation 104. The second fluid port 170 is disposed within the interior bore 112 of the downhole tool 100. The first fluid port 168 is disposed deeper in the wellbore 102 than the second fluid port 170. As described in greater detail below, the formation fluid and the wellbore fluid mix in the interior bore 112 to form an output mixture, and the controller 130 controls a concentration of the formation fluid in the output mixture.

Figure 2:
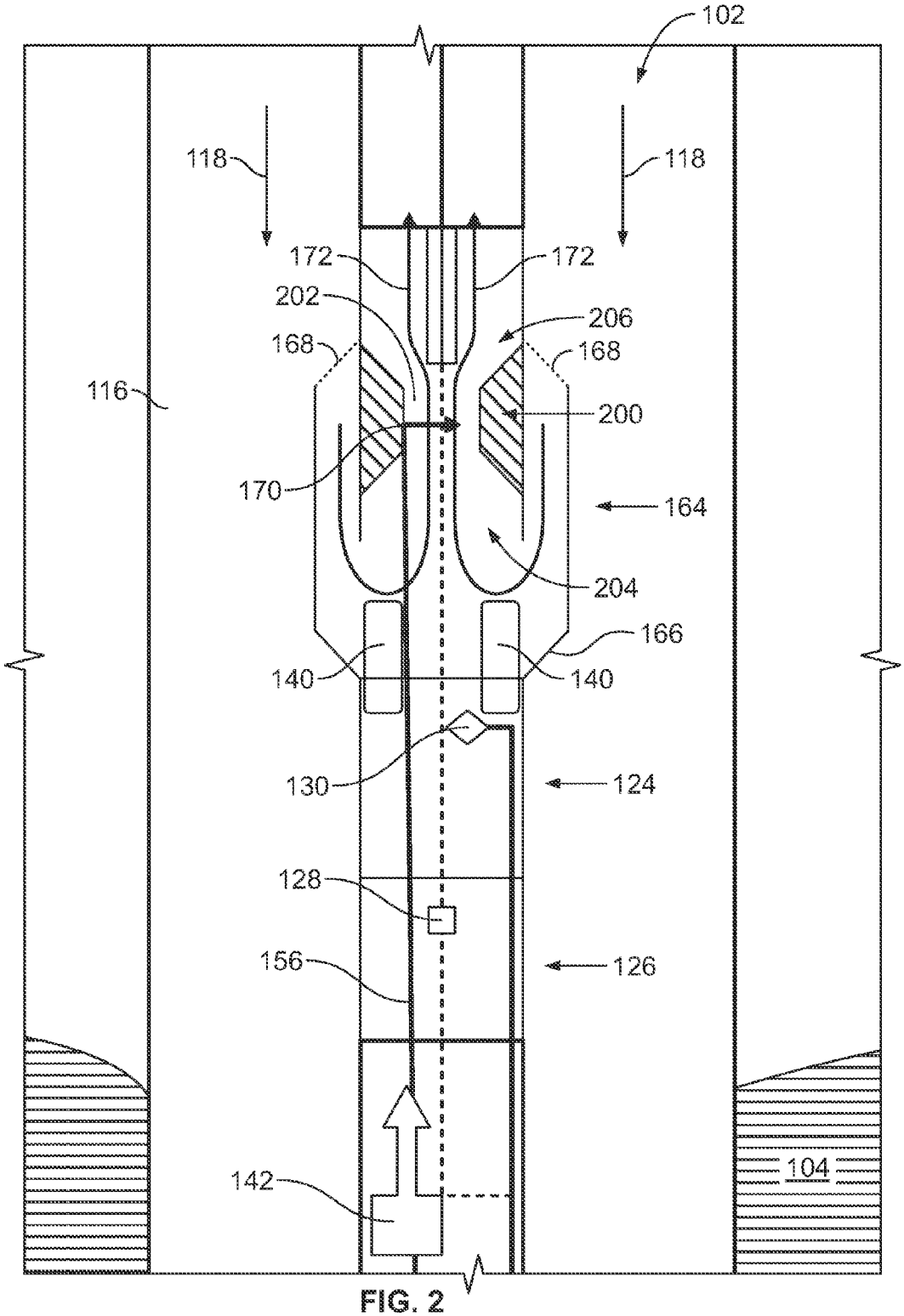
FIG. 2 is a sectional view of apparatus according to one or more aspects of the present disclosure.

FIG. 2 depicts an enlarged, cross-sectional view of a portion of the example downhole tool 100 of FIG. 1. The diverter module 164 further includes the valve 140 such as, for example, the valve described in U.S. Pat. No. 6,092,416, which is incorporated herein by reference in its entirety. The valve 140 is disposed between the first fluid port 168 and the interior bore 112 of the downhole tool 100. The controller 130 may open, close, and/or throttle the valve 140 to control the flow of wellbore fluid through the first fluid port 168.

In some examples, the diverter module 164 includes a mixer 200. In the example depicted in FIG. 2, the mixer 200 is a flow area restriction 202. In some examples, the mixer 200 is a static mixer, a dynamic mixer, and/or a pump such as, for example, a jet pump. In some examples, the mixer 200 is to cause a high pressure zone 204 upstream of the mixer 200 and a low pressure zone 206 downstream of the mixer 200 within the interior bore 112 to facilitate mixing of the formation fluid and the wellbore fluid. In the example depicted in FIG. 2, the second fluid port 170 is disposed in the flow area restriction 202 in the interior bore 112. In examples where the second fluid port 170 is disposed in the low pressure zone 206, the pressure in the low pressure zone 206 may be less than the pressure in the main flow line 156 to facilitate extraction of the formation fluid into the interior bore 112 of the downhole tool 100.

In operation, the wellbore fluid flows down the annulus 116 in the direction of the arrows 118 and into the interior bore 112 through the flow path provided by the first fluid port 168, and the formation fluid flows through the main flow line 156 into the interior bore 112 through the flow path provided by the second fluid port 170. The controller 130 controls the valve 140, which may be opened, closed, and/or throttled, to control the flow rate of wellbore fluid through the first fluid port 168. The controller 130 also controls the flow rate of the formation fluid through the second fluid port 170 by controlling the flow regulator 142.

The wellbore fluid flows downwardly into the first fluid port 168 and then diverts upwardly into the interior bore 112 to flow from the high pressure zone 204 through the flow area restriction 202 to the low pressure zone 206. As the wellbore fluid flows from the high pressure zone 204 through the flow area restriction 202, the velocity of the wellbore fluid increases. The flow paths of the wellbore fluid and the formation fluid converge in the flow area restriction 202, and the wellbore fluid mixes with the formation fluid to form an output mixture. The output mixture flows upwardly through the interior bore 112 toward the surface.

The controller 130 controls the flow rates of the wellbore fluid and the formation fluid into the interior bore 112 to control a concentration of the formation fluid in the output mixture, a pressure of the interior bore 112, and a pressure of the wellbore fluid in the annulus 116. For example, the concentration of the formation fluid in the output mixture may be controlled to be about five percent formation fluid during a sampling operation. The pressure of the interior bore 112 and the pressure of the wellbore fluid in the annulus 116 may be controlled such that the pressure in the interior bore 112 is lower than the pressure in the subterranean formation 104 while the pressure of the wellbore fluid in the annulus 116 is greater than the pressure of the subterranean formation 104 (i.e., corresponds to an overbalance condition in the annulus 116).

In some examples, the wellbore fluid flows into the interior bore 112 after the formation fluid fills at least a portion of the interior bore 112. For example, while the valve 140 is closed to prevent wellbore fluid from flowing into the interior bore 112, the formation fluid is drawn from the subterranean formation 104 into the interior bore 112. As a result, at least a portion of the interior bore 112 is filled with the formation fluid. In some examples, the valve 141 disposed along the main flow line 156 is then closed to prevent the formation fluid from flowing from the subterranean formation 104 into the interior bore 112. The valve 140 disposed between the first fluid port 168 and the interior bore 112 is then at least partially opened to flow wellbore fluid from the annulus 116 into the interior bore 112 to cause the formation fluid filling at least a portion of the interior bore 112 to flow toward the surface. The controller 130 controls the flow rate of the wellbore fluid to control the pressure of the interior bore 112 and the pressure of the wellbore fluid in the annulus 116.

Figure 3:
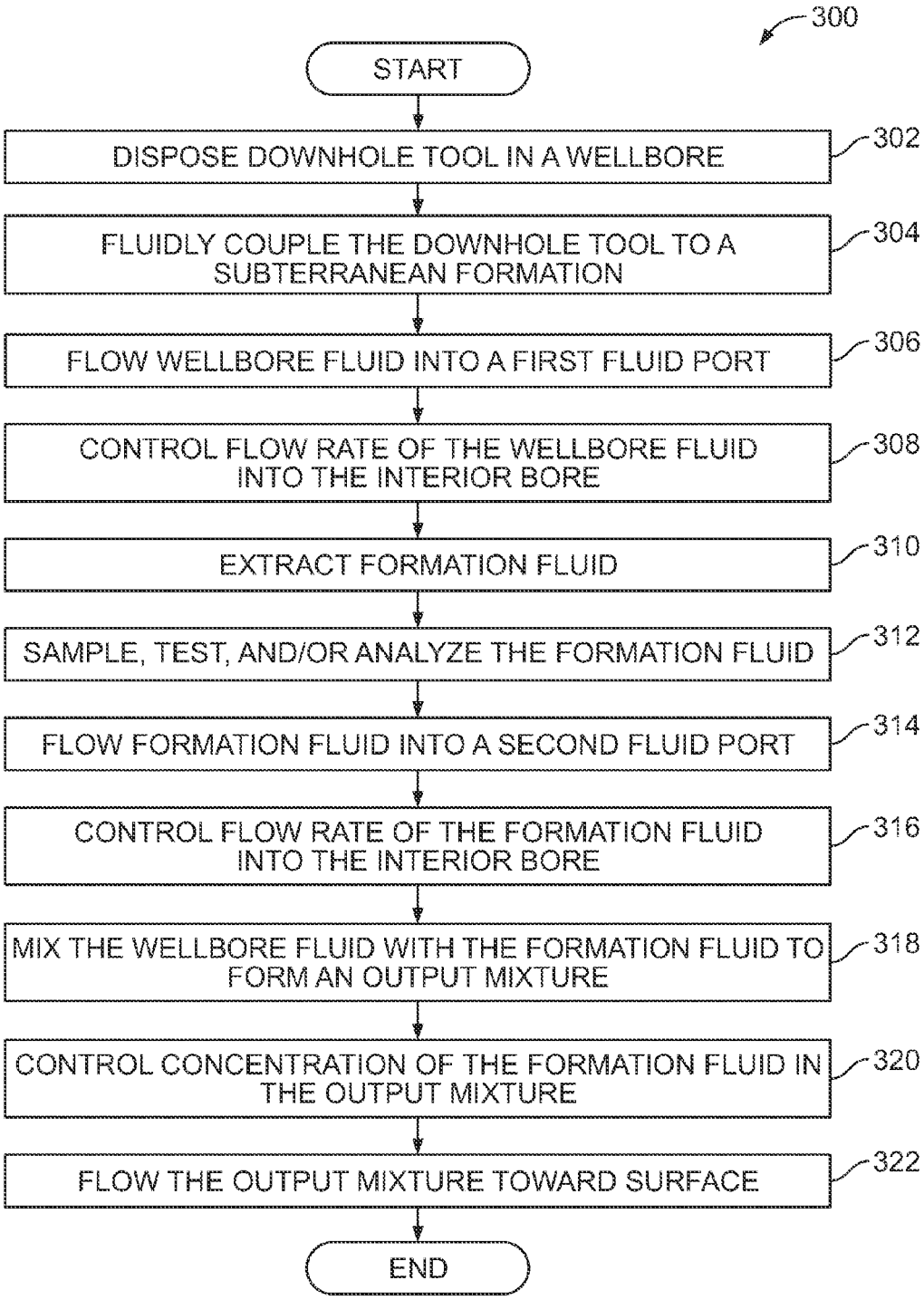
FIG. 3 is a flow diagram of at least a portion of a method according to one or more aspects of the present disclosure.

FIG. 3 is a flow diagram depicting an example process or method 300 that may be performed using the example apparatus according to the present disclosure. In FIG. 3 with reference to FIGS. 1 and 2, the process or method 300 begins by disposing the downhole tool 100 in the wellbore 102 adjacent to the subterranean formation 104 (block 302). In some examples, a low density fluid (e.g., sea water) is pumped from the rig into the annulus 116 between the exterior surface 114 of the downhole tool 100 and the wellbore 102. In such examples, the valve 140 is throttled and/or opened to provide a fluid path between the exterior surface 114 and the interior bore 112 to receive the low density fluid from the annulus 116. Once the interior bore 112 is filled with the low density fluid, the valve 140 is closed. The downhole tool is then fluidly coupled to the formation (block 304). In some examples, the packers 132, 134, 136, and 138 of the fluid admitting assembly 154 seal off or isolate a selected portion of the wall 120 of the wellbore 202 to fluidly couple the example downhole tool 100 to the adjacent formation 104. In some examples, the annulus 116 is then sealed by, for example, a hydraulic bladder provided with a blow-out preventer, and wellbore pressures are monitored. As described in greater detail below, equalizing a pressure of the low density fluid in the interior bore 112 to atmospheric pressure causes formation fluid to flow from the formation 104 into the downhole tool 100.

At block 306, wellbore fluid is flowed down the annulus 116 between the downhole tool 100 and the wall 120 of the wellbore 102 into the first fluid port 168. At block 308, the flow rate of the wellbore fluid through the first fluid port 168 into the interior bore 112 of the downhole tool 100 is controlled. In some examples, the controller 130 controls the surface pump to control the flow rate of the wellbore fluid into the interior bore 112 such that a pressure of the wellbore fluid in the annulus 116 corresponds to an overbalance condition in the annulus 116. In some examples, the controller 130 controls the valve 140 to open, close, and/or throttle the valve 140 to control the flow rate of wellbore fluid from the annulus 116 through the first fluid port 168 into the interior bore 112.

At block 310, formation fluid is extracted from the subterranean formation 104. In some examples, a pressure of the low density fluid in the interior bore 112 is equalized to atmospheric pressure at the surface to cause formation fluid to be extracted from the formation 104. After the formation fluid is extracted from the formation, the formation fluid is sampled, tested, and/or analyzed (block 312). In some examples, the formation fluid is sampled, tested, and/or analyzed by the sensors 144, 146 and 148 in the fluid analyzer modules 150 and 152. In some examples, a pressure and/or temperature of the formation fluid is monitored by, for example, the gauge 153. At block 314, the formation fluid is flowed into the second fluid port 170. At block 316, the flow rate of the formation fluid through the second fluid port 170 into the interior bore 112 is controlled. In some examples, the controller 130 controls the flow regulator 142 to control the flow rate of the formation fluid into the interior bore 112. Controlling the flow rate of wellbore fluid into the interior bore 112 also controls the flow rate of the formation fluid into the interior bore 112.

At block 318, the wellbore fluid and the formation fluid are mixed within the downhole tool 100 to form an output mixture. In some examples, the wellbore fluid flows through the mixer 200 and mixes with the formation fluid in the interior bore 112. At block 320, the concentration of the formation fluid in the output mixture is controlled. In some examples, the controller 130 controls the surface pump and the valve 140 to control the flow rate of the wellbore fluid into the interior bore 112, thereby controlling a concentration of the formation fluid in the output mixture. In some examples, the controller 130 controls the flow regulator 142 to control the flow rate of formation fluid into the interior bore 112, which also controls the concentration of the formation fluid in the output mixture.

The concentration of formation fluid in the output mixture affects the pressure of the output mixture in the interior bore 112. For example, an increase in concentration of formation fluid in the output mixture decreases the pressure of the output mixture. In some examples, the differential pressure between the wellbore fluid in the annulus 116 and the output mixture in the interior bore 112 is controlled such that the pressure of the wellbore fluid in the annulus 116 corresponds to an overbalance condition in the annulus 116 and the pressure of the output mixture in the interior bore 112 is less than the pressure of the subterranean formation 104 to facilitate extraction of the formation fluid from the subterranean formation 104. At block 322, the output mixture is flowed toward the surface. In some examples, the output mixture is separated at the surface, returned to the mud pit, disposed of, and/or pumped back into the wellbore.

Figure 4:
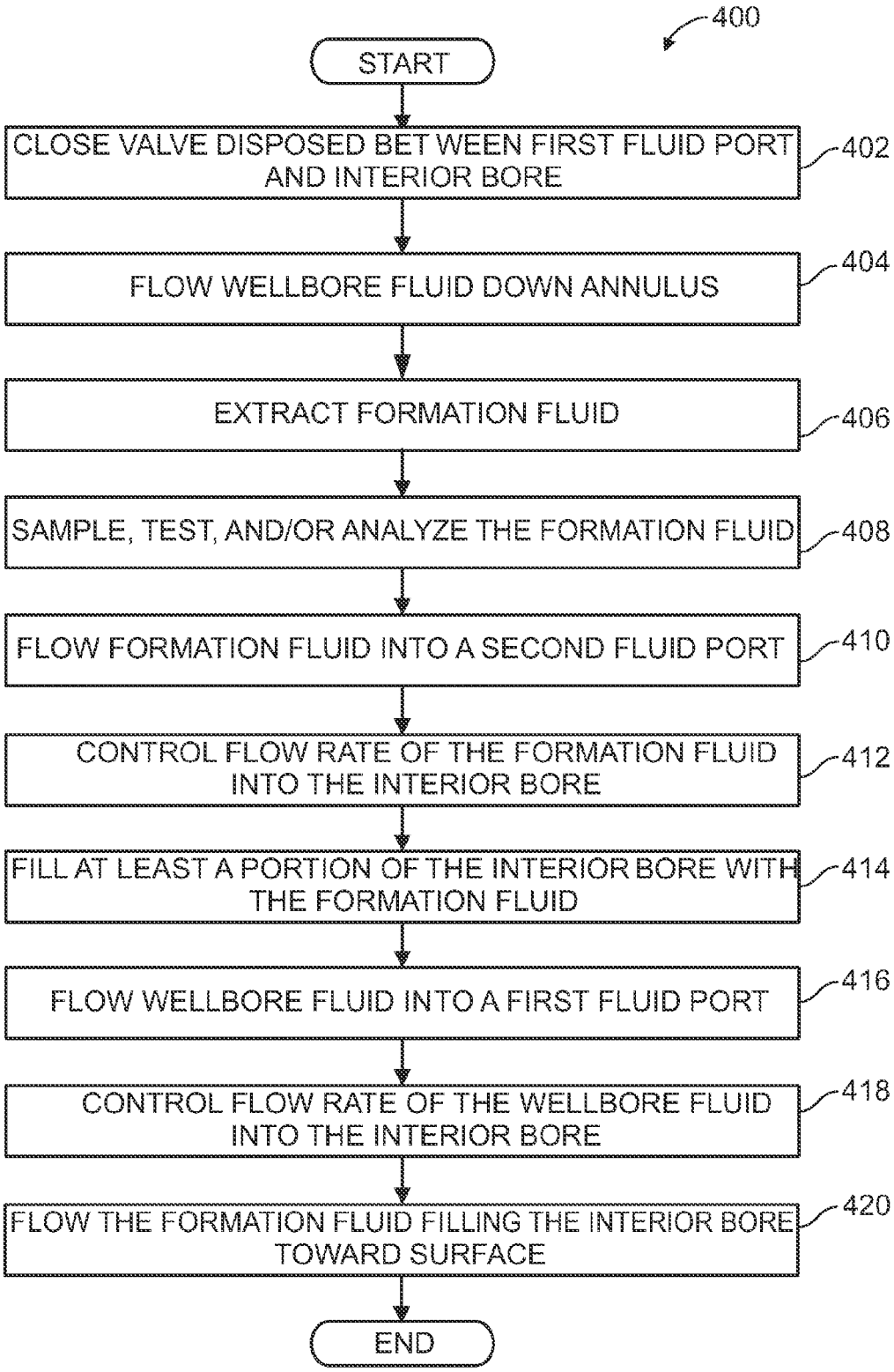
FIG. 4 is a flow diagram of at least a portion of a method according to one or more aspects of the present disclosure.

FIG. 4 is a flow diagram depicting an example process or method 400 that may be performed using the example apparatus according to the present disclosure. In FIG. 4, with reference to FIGS. 1 and 2, the process or method 400 begins by closing the valve 140 disposed between the first fluid port 168 and the interior bore 112 (block 402). Wellbore fluid is then flowed down the annulus 116 (block 404). In some examples, the flow rate of the wellbore fluid is controlled to cause the pressure of the wellbore fluid in the annulus 116 to correspond to an overbalance condition in the annulus 116. At block 406, the formation fluid is extracted from the subterranean formation 104. At block 408, the formation fluid is sampled, tested, and/or analyzed and, at block 410, the formation fluid is flowed into the second fluid port 170. The flow rate of the formation fluid into the interior bore 112 is controlled (block 412). For example, the controller 130 controls the flow regulator 142 to control the flow rate of the formation fluid into the interior bore 112. At block 414, at least a portion of the interior bore 112 is filled with the formation fluid. In some examples, the valve 141 disposed along the main flow line 156 is then closed.

At block 416, the wellbore fluid is flowed into the first fluid port 168. For example, the valve 140 is at least partially opened to cause the wellbore fluid to flow from the annulus 116 through the first fluid port 168 and into the interior bore 112. The flow rate of the wellbore fluid into the interior bore 112 is controlled (block 418). For example, the controller 130 controls the surface pump and the valve 140 to control the flow rate of the wellbore fluid into the interior bore 112 such that the pressure of the wellbore fluid in the annulus 116 corresponds to an overbalance condition in the annulus 116. At block 420, the formation fluid filling at least a portion of the interior bore 112 is flowed toward the surface. For example, the wellbore fluid flowing into the interior bore 112 displaces the formation fluid in the interior bore 112 and causes the formation fluid to flow toward the surface.

The methods 300 and 400 of FIGS. 3 and 4 are merely examples and, thus, other sequences of events or operations may be performed without departing from the scope of this disclosure. For example, the order of the blocks shown in FIGS. 3 and/or 4 may be varied and/or one or more of the operations shown in FIGS. 3 and/or 4 may be eliminated.

One or more modules or tools of the example pipe 106 shown in FIG. 1 may employ the example methods and apparatus described herein. In other examples, a wireline tool may employ the example methods and apparatus described herein. While the example apparatus and methods described herein are described in the context of drill strings and/or wireline tools, they are also applicable to any number and/or type(s) of additional and/or alternative downhole tools such as coiled tubing deployed tools.

The foregoing disclosure introduces an apparatus, comprising: a downhole tool having a body defining an interior bore and an exterior surface; first and second fluid ports to provide respective fluid paths between the exterior surface and the interior bore, the first fluid port to receive wellbore fluid from an annulus of a wellbore in which the downhole tool is to be disposed and the second fluid port to receive formation fluid extracted from a subterranean formation, where the formation fluid is to mix with the wellbore fluid to form an output mixture in the interior bore; and a controller to control a concentration of the formation fluid in the output mixture. The controller may control a differential pressure between the wellbore fluid in the annulus and the output mixture in the interior bore during a sampling operation, and the pressure of the wellbore fluid in the annulus may correspond to an overbalance condition in the annulus. The controller may control the pressure of the wellbore fluid in the annulus by controlling a flow of the wellbore fluid through the first fluid port. The apparatus may further comprise a valve where the controller may control the valve to control a flow of the wellbore fluid through the first fluid port. The apparatus may further comprise a pump where the controller may control the pump to control the flow of the wellbore fluid through the first fluid port. The controller may control a pressure of the interior bore by controlling a flow of the wellbore fluid through the first fluid port. The apparatus may further comprise a pump where the controller is to control the pump to control a flow of the formation fluid through the second fluid port to control a pressure of the interior bore. The apparatus may further comprise a mixer in the interior bore to mix the wellbore fluid received via the first fluid port and the formation fluid received via the second fluid port.

The foregoing disclosure also introduces a method, comprising: disposing a downhole tool in a wellbore adjacent to a subterranean formation; flowing wellbore fluid from an annulus between the downhole tool and the wellbore into a first fluid port of the downhole tool; flowing formation fluid from the subterranean formation into a second fluid port of the downhole tool; mixing the wellbore fluid and the formation fluid within the downhole tool to form an output mixture; and controlling a concentration of the formation fluid in the output mixture to control a differential pressure between the interior bore of the downhole tool and the subterranean formation. Controlling the concentration of the formation fluid in the output mixture may comprise controlling a flow rate of the wellbore fluid into the first fluid port, and controlling the flow rate of the wellbore fluid into the first fluid port may comprise controlling a valve. Controlling the concentration of the formation fluid in the output mixture may comprise controlling a flow rate of the formation fluid into the second fluid port. A pressure of the wellbore fluid in the annulus may correspond to an overbalance condition in the annulus.

The foregoing disclosure also introduces a method, comprising: disposing a downhole tool in a wellbore adjacent to a subterranean formation; controlling a flow rate of formation fluid from the subterranean formation into an interior bore of the downhole tool; controlling a flow rate of wellbore fluid from an annulus between the downhole tool and the wellbore into the interior bore of the downhole tool; and mixing the wellbore fluid and the formation fluid to form an output mixture and cause a differential pressure between the wellbore annulus and the interior bore of the downhole tool. Controlling the flow rate of the formation fluid from the subterranean formation into the interior bore of the downhole tool may comprise controlling a pump. Controlling the flow rate of the wellbore fluid into the interior bore of the downhole tool may comprise controlling a valve. Controlling the flow rate of the wellbore fluid into the interior bore of the downhole tool may comprise controlling a pump. A pressure of the wellbore fluid in the annulus may correspond to an overbalance condition in the annulus. Controlling the flow rate of the formation fluid and the flow rate of the wellbore fluid may control a concentration of formation fluid in the output mixture.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A downhole tool comprising:

a body defining an interior bore and an exterior surface;

first and second fluid ports to provide respective fluid paths between the exterior surface and the interior bore, the first fluid port disposed in the exterior surface to receive wellbore fluid from an annulus of a wellbore in which the downhole tool is to be disposed and the second fluid port disposed in the interior bore to receive formation fluid extracted from a subterranean formation;

an inlet disposed in the exterior surface to receive the formation fluid;

a mixer disposed in the interior bore and fluidly coupled to the first and second fluid ports, wherein the mixer is configured to mix the formation fluid with the wellbore fluid to form an output mixture in the interior bore;

a valve disposed between the first fluid port and the interior bore, wherein the valve is configured to control a flow rate of the wellbore fluid through the first fluid port;

a pump to draw the formation fluid through the downhole tool from the inlet to the second fluid port, wherein the pump is configured to control a flow rate of the formation fluid into the interior bore;

a flowline disposed within the interior bore, wherein the flowline is coupled to the inlet and the pump; and a controller to govern operation of the pump and the valve to maintain a concentration of the formation fluid in the output mixture.

2. The apparatus of claim 1 wherein the controller is to control a differential pressure between the wellbore fluid in the annulus and the output mixture in the interior bore during a formation sampling operation.

3. The apparatus of claim 2 wherein a pressure of the wellbore fluid in the annulus corresponds to an overbalance condition in the annulus.

4. The apparatus of claim 2 wherein the controller is to control the pressure of the wellbore fluid in the annulus by controlling the valve.

5. The apparatus of claim 1 wherein the fluid path provided by the first fluid port extends from the exterior surface to the interior bore, and further comprising the valve disposed in the fluid path provided by the first fluid port, wherein the controller is to control the valve to control a flow of the wellbore fluid through the first fluid port.

6. The apparatus of claim 1 wherein the controller is to control a pressure of the interior bore by controlling the valve.

7. The apparatus of claim 1 wherein the controller is to control the pump to control a pressure of the interior bore.

8. The apparatus of claim 1, wherein the controller is configured to determine the concentration based on an operating mode of the downhole tool.

9. A method, comprising:

disposing a downhole tool in a wellbore adjacent to a subterranean formation;

flowing wellbore fluid from an annulus between the downhole tool and the wellbore into a first fluid port of the downhole tool;

controlling a flow rate of the wellbore fluid through the first fluid port using a valve disposed between the first fluid port and an interior passage of the downhole tool;

flowing formation fluid from the subterranean formation into an inlet of the downhole tool;

operating a pump to flow formation fluid from the inlet through a flowline disposed within the interior passage of the downhole tool into a second fluid port opening into the interior passage of the downhole tool;

controlling a flow rate of the formation fluid into the interior passage using the pump;

mixing the wellbore fluid and the formation fluid within the interior passage to form an output mixture using a mixer fluidly coupled to the first and second fluid ports; and governing operation of the pump and the valve to maintain a concentration of the formation fluid in the output mixture.

10. The method of claim 9 wherein maintaining the concentration of the formation fluid in the output mixture comprises controlling the valve.

11. The method of claim 9 wherein a pressure of the wellbore fluid in the annulus corresponds to an overbalance condition in the annulus.

12. A method, comprising:

disposing a downhole tool in a wellbore adjacent to a subterranean formation;

operating a pump to control a flow rate of formation fluid from the subterranean formation through a flowline disposed within an interior bore of the downhole tool into the interior bore of the downhole tool;

operating a valve to control a flow rate of wellbore fluid from an annulus between the downhole tool and the wellbore into the interior bore of the downhole tool mixing the wellbore fluid and the formation fluid to form an output mixture in the interior bore using a mixer; and adjusting operation of the pump and the valve to maintain a concentration of the formation fluid in the output mixture.

13. The method of claim 12 wherein a pressure of the wellbore fluid in the annulus corresponds to an overbalance condition in the annulus.

14. The method of claim 12, comprising operating the pump and the valve to achieve a desired differential pressure between the wellbore annulus and the interior bore of the downhole tool.

* * * * *